US011492677B2

(12) United States Patent
Hasegawa et al.

(10) Patent No.: US 11,492,677 B2
(45) Date of Patent: Nov. 8, 2022

(54) HIGH-STRENGTH STEEL SHEET AND METHOD FOR PRODUCING THE SAME

(71) Applicant: JFE Steel Corporation, Tokyo (JP)

(72) Inventors: Hiroshi Hasegawa, Tokyo (JP); Hidekazu Minami, Tokyo (JP); Tatsuya Nakagaito, Tokyo (JP); Kana Sasaki, Tokyo (JP); Shoji Tanaka, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 376 days.

(21) Appl. No.: 16/957,739

(22) PCT Filed: Oct. 9, 2018

(86) PCT No.: PCT/JP2018/037569
§ 371 (c)(1),
(2) Date: Jun. 25, 2020

(87) PCT Pub. No.: WO2019/130713
PCT Pub. Date: Jul. 4, 2019

(65) Prior Publication Data

US 2021/0062282 A1 Mar. 4, 2021

(30) Foreign Application Priority Data

Dec. 27, 2017 (JP) ..... JP2017-251048

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/60*** | (2006.01) |
| ***C23C 2/40*** | (2006.01) |

(52) U.S. Cl.
CPC ..... *C21D 9/46* (2013.01); *C21D 8/0226* (2013.01); *C21D 8/0236* (2013.01); *C21D 8/0273* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/60* (2013.01); *C23C 2/40* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 9/46
See application file for complete search history.

(56) References Cited

U.S. PATENT DOCUMENTS

| | | | |
|---|---|---|---|
| 10,370,737 | B2 | 8/2019 | Hasegawa et al. |
| 2010/0132848 | A1 | 6/2010 | Ikeda et al. |
| 2014/0234659 | A1 | 8/2014 | Kawata et al. |
| 2014/0251513 | A1 | 9/2014 | Kami et al. |
| 2016/0312329 | A1 | 10/2016 | Hasegawa et al. |
| 2017/0088914 | A1 | 3/2017 | Ikeda et al. |
| 2017/0260599 | A1 | 9/2017 | Puerta Velasquez et al. |
| 2018/0002771 | A1 | 1/2018 | Han et al. |
| 2018/0010227 | A1 | 1/2018 | Ikeda et al. |
| 2018/0030565 | A1 | 2/2018 | Hasegawa et al. |
| 2018/0171459 | A1 | 6/2018 | Drillet et al. |
| 2019/0040511 | A1 | 2/2019 | Hasegawa et al. |

FOREIGN PATENT DOCUMENTS

| | | | |
|---|---|---|---|
| CN | 103827341 | A | 5/2014 |
| CN | 104245999 | A | 12/2014 |
| CN | 104928579 | A | 9/2015 |
| CN | 105531388 | A | 4/2016 |
| CN | 106987790 | A | 7/2017 |
| CN | 108603263 | A | 9/2018 |
| CN | 110121568 | A | 8/2019 |
| EP | 2762600 | A1 | 8/2014 |

(Continued)

OTHER PUBLICATIONS

Korean Notice of Allowance for Korean Application No. 10-2020-7018283, dated Apr. 20, 2022, with translation, 4 pages.
Zhongzhi et al., "Electrical Steel", Beijing Metallurgical Industry Press, 2012, 4 pages.
Chinese Office Action for Chinese Application No. 201880084272.0, dated Apr. 6, 2021 with Concise Statement of Relevance of Office Action, 15 pages.
Korean Office Action for Korean Application No. 10-2020-7018283, dated Oct. 15, 2021, with Concise Statement of Relevance of Office Action, 7 pages.
Extended European Search Report for European Application No. 18 895 022.4, dated Oct. 26, 2020, 14 pages.

(Continued)

*Primary Examiner* — Jophy S. Koshy
(74) *Attorney, Agent, or Firm* — RatnerPrestia

(57) ABSTRACT

A high-strength steel sheet has a specific composition and a microstructure. In the microstructure, the area fraction of elongated ferrite phase grains having an aspect ratio of 3 or more is 1% or less, the average crystal grain size of martensite included in a region extending 50 μm from a surface of the steel sheet is 20 μm or less, the content of oxide particles having a minor axis length of 0.8 μm or less in the region extending 50 μm from the surface of the steel sheet is $1.0\times10^{10}$ particles/$m^2$ or more, and the content of coarse oxide particles having a minor axis length of more than 1 μm in the region extending 50 μm from the surface of the steel sheet is $1.0\times10^{8}$ particles/$m^2$ or less. The content of hydrogen trapped in the steel sheet is 0.05 ppm by mass or more.

24 Claims, No Drawings

(56) References Cited

FOREIGN PATENT DOCUMENTS

| | | | |
|---|---|---|---|
| EP | 2762603 | A1 | 8/2014 |
| EP | 2944705 | A1 | 11/2015 |
| EP | 3040440 | A1 | 7/2016 |
| EP | 3409807 | A1 | 12/2018 |
| EP | 3421633 | A1 | 1/2019 |
| EP | 3564400 | A1 | 11/2019 |
| JP | 2005063548 | A | 3/2005 |
| JP | 2009275266 | A | 11/2009 |
| JP | 2010126787 | A | 6/2010 |
| JP | 5402357 | B2 | 1/2014 |
| JP | 5633653 | B1 | 12/2014 |
| JP | 2013047812 | A1 | 3/2015 |
| JP | 5803836 | B2 | 11/2015 |
| JP | 2015193907 | A | 11/2015 |
| JP | 2016128598 | A | 7/2016 |
| JP | 2017002384 | A | 1/2017 |
| JP | 2017048412 | A | 3/2017 |
| JP | 2018012884 | A | 1/2018 |
| JP | 2018521222 | A | 8/2018 |
| WO | 2013047760 | A1 | 4/2013 |
| WO | 2015198582 | A | 12/2015 |
| WO | 2016098964 | A1 | 6/2016 |
| WO | 2016113788 | A1 | 7/2016 |
| WO | 2016129213 | A1 | 8/2016 |
| WO | 2017131054 | A1 | 8/2017 |
| WO | 2017168962 | A1 | 10/2017 |

OTHER PUBLICATIONS

International Search Report and Written Opinion for International Application No. PCT/JP2018/037569, dated Jan. 15, 2019, 6 pages.

HIGH-STRENGTH STEEL SHEET AND METHOD FOR PRODUCING THE SAME

CROSS REFERENCE TO RELATED APPLICATIONS

This is the U.S. National Phase application of PCT/JP2018/037569, filed Oct. 9, 2018, which claims priority to Japanese Patent Application No. 2017-251048 filed Dec. 27, 2017, the disclosures of these applications being incorporated herein by reference in their entireties for all purposes.

FIELD OF THE INVENTION

The present invention relates to a high-strength steel sheet excellent in terms of strength and workability and suitable for an automotive member and a method for producing the high-strength steel sheet.

BACKGROUND OF THE INVENTION

Steel sheets used for producing automotive components have been required to have high strengths in order to improve the collision safety and the fuel economy of automobiles. Since an increase in the strength of a steel sheet commonly leads to the degradation of the workability (bendability) of the steel sheet, the development of a steel sheet excellent in terms of strength and workability has been anticipated. While the application of high-strength steel sheets having a tensile strength (hereinafter, abbreviated as "TS") of more than 980 MPa has been increased recently, the high-strength steel sheets are typically worked into members, rocker components, and the like having a straight shape by primarily being bent because of great difficulty in forming the high-strength steel sheets into shape. Therefore, in such steel sheets, having excellent bendability have been anticipated. Accordingly, there have been various attempts to develop high-strength steel sheets having excellent bendability. For example, Patent Literature 1 discloses a technology in which a steel sheet having excellent bendability is produced by reducing the average crystal grain size of tempered-martensite. Patent Literature 2 discloses a technology in which a steel sheet having excellent bendability is produced by controlling the contents and shapes of inclusions and precipitates.

PATENT LITERATURE

PTL 1: International Publication No. 2016-113788
PTL 2: International Publication No. 2015-198582

SUMMARY OF THE INVENTION

A high-strength steel sheet more excellent in both strength and workability than the related art, such as Patent Literature 1 and Patent Literature 2, and a method for producing the high-strength steel sheet are anticipated.

Aspects of the present invention were made to address the above issue. An object according to aspects of the present invention is to provide a high-strength steel sheet further excellent in both strength and workability and a method for producing the high-strength steel sheet.

In Patent Literature 1 and Patent Literature 2, attention is focused on only the microstructure of steel or the inclusions present in a steel sheet, and no discussion is made focusing on the hydrogen trapped in steel, that is, "trapped hydrogen".

The inventors of the present invention focused on the trapped hydrogen and made the present invention as described below.

The inventors of the present invention conducted extensive studies in order to achieve the above object and, as a result, found that the bendability of a steel sheet may be markedly enhanced when hydrogen is introduced into the steel sheet so as to be trapped by oxides and form trapped hydrogen while the microstructure of the steel sheet is optimized.

Specifically, a steel sheet may have a high strength and excellent bendability when the composition of the steel sheet is adjusted to be a specific composition; the microstructure of the steel sheet includes lower bainite, martensite, retained austenite, upper bainite, and ferrite such that the total area fraction of the lower bainite, the martensite, and the retained austenite is 40% to 100%, the area fraction of the retained austenite is 15% or less, and the total area fraction of the upper bainite and the ferrite is 0% to 60%; in the microstructure, the area fraction of elongated ferrite phase grains having an aspect ratio of 3 or more is adjusted to be 1% or less, the average crystal grain size of martensite included in a region extending 50 μm from a surface of the steel sheet is adjusted to be 20 μm or less, the content of oxide particles having a minor axis length of 0.8 μm or less in the region extending 50 μm from the surface of the steel sheet is adjusted to be $1.0\times10^{10}$ particles/$m^2$ or more, and the content of coarse oxide particles having a minor axis length of more than 1.0 μm in the region extending 50 μm from the surface of the steel sheet is adjusted to be $1.0\times10^{8}$ particles/$m^2$ or less; and the content of hydrogen trapped in the steel sheet is adjusted to be 0.05 ppm by mass or more.

In accordance with aspects of the present invention, the term "high strength" refers to the TS of the steel sheet being 980 MPa or more and being preferably 1180 MPa or more. The term "excellent bendability" used herein refers to the ratio (R/t) of the minimum bend radius R at which microcracks are absent to the thickness t of the steel sheet being 1.5 or less when the TS is 980 MPa or more and less than 1180 MPa, 2.5 or less when the TS is 1180 MPa or more and less than 1320 MPa, 3.5 or less when the TS is 1320 MPa or more and less than 1600 MPa, and 5.0 or less when the TS is 1600 MPa or more and less than 2100 MPa.

In accordance with aspects of the present invention, the term "microcracks" refers to cracks having a length of 0.5 mm or more.

Aspects of the present invention were made on the basis of the above findings. The summary of aspects of the present invention is as follows.

[1] A high-strength steel sheet including a composition containing, by mass, C: 0.05% to 0.40%, Si: 0.10% to 3.0%, Mn: 1.5% to 4.0%, P: 0.100% or less (excluding 0%), S: 0.02% or less (excluding 0%), Al: 0.010% to 1.0%, and N: 0.010% or less, with the balance being Fe and inevitable impurities; a microstructure including lower bainite, martensite, retained austenite, upper bainite, and ferrite such that the total area fraction of the lower bainite, the martensite, and the retained austenite is 40% to 100%, the area fraction of the retained austenite is 15% or less, and the total area fraction of the upper bainite and the ferrite is 0% to 60%, wherein, in the microstructure, the area fraction of elongated ferrite phase grains having an aspect ratio of 3 or more is 1% or less, the average crystal grain size of martensite included in a region extending 50 μm from a surface of the steel sheet is 20 μm or less, the content of oxide particles having a minor axis length of 0.8 μm or less in the region extending 50 μm from the surface of the steel sheet is $1.0\times10^{10}$ particles/$m^2$ or more, and the content of coarse oxide particles having a minor axis length of more than 1.0 μm in the region extending 50 μm from the surface of the steel sheet is $1.0\times10^8$ particles/$m^2$ or less; and a content of hydrogen trapped in the steel sheet is 0.05 ppm by mass or more.

[2] The high-strength steel sheet described in [1], further including one or more elements selected from, by mass, Cr: 0.005% to 2.0%, Ti: 0.005% to 0.20%, Nb: 0.005% to 0.20%, Mo: 0.005% to 2.0%, V: 0.005% to 2.0%, Ni: 0.005% to 2.0%, Cu: 0.005% to 2.0%, B: 0.0001% to 0.0050%, Ca: 0.0001% to 0.0050%, REM: 0.0001% to 0.0050%, Sn: 0.01% to 0.50%, and Sb: 0.0010% to 0.10%.

[3] The high-strength steel sheet described in [1] or [2], including a coating film constituted by one or more layers, the coating film being disposed on the surface of the steel sheet.

[4] The high-strength steel sheet described in [1] or [2], including a galvanizing layer disposed on the surface of the steel sheet.

[5] The high-strength steel sheet described in [1] or [2], including an alloyed hot-dip galvanizing layer disposed on the surface of the steel sheet.

[6] A method for producing a high-strength steel sheet, the method including a hot-rolling step of rough-rolling a slab having the composition described in [1] or [2], subsequently performing descaling at a pressure of 15 MPa or more, then performing finish rolling at 800° C. to 950° C., performing cooling subsequent to the finish rolling, and then performing coiling at 550° C. or less; an annealing step of heating a hot-rolled steel sheet produced in the hot-rolling step to 730° C. to 950° C. and performing holding at 730° C. to 950° C. in an atmosphere having a hydrogen concentration of 1.0% to 35.0% by volume and a dew point of −35° C. to 15° C. for 10 to 1000 s; a cooling step of cooling a steel sheet treated in the annealing step to 600° C. at an average rate of 5° C./s or more, stopping the cooling at a temperature of more than Ms and 600° C. or less, subsequently performing retention at a temperature of more than Ms and 600° C. or less for 1000 s or less, and, subsequent to the retention, performing cooling to room temperature such that the average cooling rate between Ms and 50° C. is 1.0° C./s or more; an elongation rolling step of rolling a steel sheet treated in the cooling step at an elongation ratio of 0.05% to 1%; and an aging treatment step of subjecting a steel sheet treated in the elongation rolling step to an aging treatment under conditions satisfying Formula (1) below, $$(273+T)\times(20+\log_{10}(t))\geq6800, \quad (1)$$

where T is a temperature (° C.) of 200° C. or less, and t is a time (hr).

[7] A method for producing a high-strength steel sheet, the method including a hot-rolling step of rough-rolling a slab having the composition described in [1] or [2], subsequently performing descaling at a pressure of 15 MPa or more, then performing finish rolling at 800° C. to 950° C., performing cooling subsequent to the finish rolling, and then performing coiling at 550° C. or less; a cold-rolling step of cold-rolling a hot-rolled steel sheet produced in the hot-rolling step at a rolling reduction ratio of 20% or more; an annealing step of heating a cold-rolled steel sheet produced in the cold-rolling step to 730° C. to 950° C. and performing holding at 730° C. to 950° C. in an atmosphere having a hydrogen concentration of 1% to 35% by volume and a dew point of −35° C. to 15° C. for 10 to 1000 s; a cooling step of cooling a steel sheet treated in the annealing step to 600° C. at an average rate of 5° C./s or more, stopping the cooling at a temperature of more than Ms and 600° C. or less, subsequently performing retention at a temperature of more than Ms and 600° C. or less for 1000 s or less, and, subsequent to the retention, performing cooling to room temperature such that the average cooling rate between Ms and 50° C. is 1° C./s or more; an elongation rolling step of rolling a steel sheet treated in the cooling step at an elongation ratio of 0.05% to 1%; and an aging treatment step of subjecting a steel sheet treated in the elongation rolling step to an aging treatment under conditions satisfying Formula (1) below, $$(273+T)\times(20+\log_{10}(t))\geq6800, \quad (1)$$

where T is a temperature (° C.) of 200° C. or less, and t is a time (hr).

[8] The method for producing a high-strength steel sheet described in [6] or [7], wherein a coating film formation treatment is performed in any of the steps subsequent to the annealing step.

[9] The method for producing a high-strength steel sheet described in [6] or [7], wherein a galvanizing treatment is performed in the cooling step.

[10] The method for producing a high-strength steel sheet described in [9], wherein an alloying treatment is further performed subsequent to the galvanizing treatment.

According to aspects of the present invention, a high-strength steel sheet having excellent bendability can be produced. The high-strength steel sheet can be suitable as a material for automotive components.

DETAILED DESCRIPTION OF EMBODIMENTS OF THE INVENTION

An embodiment of the present invention is described below. The present invention is not limited to the embodiment below.

Firstly, the composition of the high-strength steel sheet according to aspects of the present invention is described below. In the following description, "%" used for describing the content of an element means "% by mass" unless otherwise specified. In accordance with aspects of the present invention, "to" means that the values described before and after "to" are included as the lower and upper limits, respectively.

C: 0.05% to 0.40%

C is an element that causes the formation of martensite, bainite, and the like and thereby effectively increases the TS of the steel sheet. If the C content is less than 0.05%, the above advantageous effects may fail to be achieved sufficiently and, consequently, a TS of 980 MPa or more may fail to be achieved. Accordingly, the C content is limited to be 0.05% or more. The C content is preferably 0.07% or more, is more preferably 0.09% or more, and is still more preferably 0.11% or more. If the C content exceeds 0.40%, hardening of martensite may occur, which may significantly degrade the bendability of the steel sheet. Accordingly, the C content is limited to be 0.40% or less. The C content is preferably 0.37% or less, is more preferably 0.35% or less, and is further preferably 0.32% or less.

Si: 0.10% to 3.0%

Si is an element that causes the solid-solution strengthening of steel and thereby effectively increases the TS of the steel sheet. In addition, oxides including Si are effective in trapping hydrogen. In order to achieve the advantageous effect of oxides including Si, the Si content is limited to be 0.10% or more. The Si content is preferably 0.20% or more, is more preferably 0.30% or more, and is further preferably 0.40% or more. If the Si content exceeds 3.0%, steel may become brittle and the bendability of the steel sheet may become significantly degraded. Accordingly, the Si content is limited to be 3.0% or less. The Si content is preferably 2.5% or less, is more preferably 2.0% or less, and is further preferably 1.8% or less.

Mn: 1.5% to 4.0%

Mn is an element that causes the formation of martensite, bainite, and the like and thereby effectively increases the TS of the steel sheet. If the Mn content is less than 1.5%, the above advantageous effects may fail to be achieved sufficiently and, consequently, a TS of 980 MPa or more may fail to be achieved. Accordingly, the Mn content is limited to be 1.5% or more. The Mn content is preferably 1.8% or more, is more preferably 2.0% or more, and is further preferably 2.2% or more. If the Mn content exceeds 4.0%, steel may become brittle and the bendability required in accordance with aspects of the present invention may fail to be achieved. Accordingly, the Mn content is limited to be 4.0% or less. The Mn content is preferably 3.8% or less, is more preferably 3.6% or less, and is further preferably 3.4% or less.

P: 0.100% or Less (Excluding 0%)

Since P causes grain boundary embrittlement and thereby degrades the bendability of the steel sheet, it is desirable to reduce the P content to a minimum level. The P content allowable in accordance with aspects of the present invention is 0.100% or less. The P content is preferably 0.050% or less. Although the lower limit is not specified, the P content is preferably 0.001% or more in consideration of production efficiency, because production efficiency may be reduced if the P content is less than 0.001%.

S: 0.02% or Less (Excluding 0%)

Since S causes an increase in the content of inclusions and thereby degrades the bendability of the steel sheet, it is preferable to reduce the S content to a minimum level. The S content allowable in accordance with aspects of the present invention is 0.02% or less. The S content is preferably 0.01% or less. Although the lower limit is not specified, the S content is preferably 0.0005% or more in consideration of production efficiency, because production efficiency may be reduced if the S content is less than 0.0005%.

Al: 0.010% to 1.0%

Al serves as a deoxidizing agent and is preferably added to steel in a deoxidation process. Accordingly, the Al content is limited to be 0.010% or more. The Al content is preferably 0.015% or more. If the Al content is excessively high, a large amount of soft ferrite phase may be formed, which results in a reduction in TS. The Al content allowable in accordance with aspects of the present invention is 1.0% or less. The Al content is preferably 0.50% or less.

N: 0.010% or Less

If the N content exceeds 0.010%, coarse nitride particles may be formed, which results in the degradation of bendability. Accordingly, the N content is limited to be 0.010% or less. Although the lower limit is not specified, the N content is preferably 0.0005% or more in consideration of production efficiency, because production efficiency may be reduced if the N content is less than 0.0005%.

The composition according to aspects of the present invention may contain the elements described below as optional constituents.

Cr: 0.005% to 2.0%, Ti: 0.005% to 0.20%, Nb: 0.005% to 0.20%, Mo: 0.005% to 2.0%, V: 0.005% to 2.0%, Ni: 0.005% to 2.0%, Cu: 0.005% to 2.0%, B: 0.0001% to 0.0050%, Ca: 0.0001% to 0.0050%, REM: 0.0001% to 0.0050%, Sn: 0.01% to 0.50%, and Sb: 0.0010% to 0.10%

Cr, Cu, and Ni are elements that cause the formation of martensite and bainite and thereby effectively increase the strength of the steel sheet. In order to achieve the above advantageous effects, the contents of Cr, Cu, and Ni are preferably 0.005% or more. The contents of Cr, Cu, and Ni are more preferably 0.010% or more and are further preferably 0.050% or more. If the content of Cr, Cu, or Ni exceeds 2.0%, a large amount of retained austenite may remain in steel and, consequently, the bendability of the steel sheet may become slightly degraded. Accordingly, the contents of Cr, Cu, and Ni are preferably 2.0% or less. The contents of Cr, Cu, and Ni are more preferably 1.5% or less and are further preferably 1.0% or less.

Ti, Nb, V, and Mo are elements that cause the formation of carbides and thereby effectively increase the strength of the steel sheet. In order to achieve the above advantageous effects, the contents of Ti, Nb, V, and Mo are preferably 0.005% or more and are more preferably 0.010% or more. If the content of Ti, Nb, V, or Mo exceeds its upper limit, carbide particles may coarsen and the content of dissolved carbon may be reduced, which results in a reduction in the hardness of steel. Accordingly, the Ti content is preferably 0.20% or less, is more preferably 0.10% or less, and is further preferably 0.05% or less. The Nb content is preferably 0.20% or less, is more preferably 0.10% or less, and is further preferably 0.05% or less. The V content is preferably 2.0% or less, is more preferably 1.0% or less, and is further preferably 0.5% or less. The Mo content is preferably 2.0% or less, is more preferably 1.0% or less, and is further preferably 0.5% or less.

B is an element that enhances the hardenability of the steel sheet, causes the formation of martensite and bainite, and thereby effectively increases the strength of the steel sheet. In order to achieve the above advantageous effects, the B content is preferably 0.0001% or more and is more preferably 0.0005% or more. If the B content exceeds 0.0050%, the amount of inclusions may be increased and, consequently, the bendability of the steel sheet may become slightly degraded. Accordingly, the B content is preferably 0.0050% or less and is more preferably 0.0030% or less.

Ca and REM are elements that effectively enhance the bendability of the steel sheet by controlling the shapes of inclusions. In order to achieve the above advantageous effect, the contents of Ca and REM are preferably 0.0001% or more and are more preferably 0.0005% or more. If the content of Ca or REM exceeds 0.0050%, the amount of inclusions may be increased and, consequently, the bendability of the steel sheet may become slightly degraded. Accordingly, the contents of Ca and REM are preferably 0.0050% or less and are more preferably 0.0030% or less.

Sn and Sb are elements that effectively limit a reduction in the strength of steel by reducing decarburization, denitrification, boron removal, and the like. In order to achieve the above advantageous effects, the Sn content is preferably 0.01% or more or the Sb content is preferably 0.0010% or more. If the content of Sn or Sb exceeds its upper limit, grain boundary embrittlement may occur, which slightly degrades the bendability of the steel sheet. Accordingly, the Sn content is preferably 0.50% or less and is more preferably 0.10% or less. The Sb content is preferably 0.10% or less and is more preferably 0.05% or less.

The balance includes Fe and inevitable impurities. When the content of any of the above optional constituents is less than its lower limit, it is considered that the optional constituent serves as an inevitable impurity. The composition according to aspects of the present invention may optionally contain Zr, Mg, La, Ce, Bi, W, and Pb as inevitable impurities such that the total content of Zr, Mg, La, Ce, Bi, W, and Pb is 0.002% or less.

Total Area Fraction of Lower Bainite, Martensite, and Retained Austenite: 40% to 100%

If the total area fraction of lower bainite, martensite, and retained austenite is less than 40%, a TS of 980 MPa or more may fail to be achieved. Accordingly, the above total area fraction is limited to be 40% to 100%, is preferably 45% to 100%, and is more preferably 50% to 100%. The term "martensite" used herein refers to both as-quenched martensite and tempered martensite. The term "lower bainite" used herein refers to bainite that includes uniformly aligned carbide particles. Lower bainite may include tempered bainite.

The area fraction of martensite in the overall microstructure is preferably 30% or more and is more preferably 35% or more. The upper limit for the area fraction of martensite is preferably 99% or less, is more preferably 97% or less, and is further preferably 95% or less.

Area Fraction of Retained Austenite: 15% or Less

Retained austenite may transform into martensite in a bending work to promote the formation of cracks. The adverse effect becomes significant if the area fraction of retained austenite in the overall microstructure exceeds 15%. Accordingly, the area fraction of retained austenite is limited to be 15% or less, is preferably 10% or less, and is more preferably 8% or less. Although the lower limit for the area fraction of retained austenite is not specified and the area fraction of retained austenite may be 0%, the area fraction of retained austenite is preferably 1% or more and is more preferably 2% or more.

Total Area Fraction of Upper Bainite and Ferrite: 0% to 60%

If the total area fraction of upper bainite and ferrite exceeds 60%, a TS of 980 MPa or more may fail to be achieved. Accordingly, the total area fraction of upper bainite and ferrite is limited to be 0% to 60%, is preferably 0% to 50%, and is more preferably 0% to 45%. In particular, as for high-strength steel, the smaller the total area fraction of upper bainite and ferrite, the more preferable the steel sheet in terms of bendability. The above total area fraction is preferably 10% or less when the TS is 1320 MPa or more and less than 1600 MPa. The above total area fraction is preferably 3% or less when the TS is 1600 MPa or more and less than 2100 MPa. The term "upper bainite" used herein refers to bainite that does not include uniformly aligned carbide particles.

Area Fraction of Elongated Ferrite Phase Grains Having Aspect Ratio of 3 or More:1% or Less Elongated ferrite phase grains having a high aspect ratio may promote occurrence of cracking in a bending work and degrade the bendability of the steel sheet. In order to inhibit the adverse effects, it is necessary to limit the area fraction of elongated ferrite phase grains having an aspect ratio of 3 or more in the overall microstructure to be 1% or less. Accordingly, the area fraction of elongated ferrite phase grains having an aspect ratio of 3 or more is limited to be 1% or less.

Other Microstructure Components

The microstructure according to aspects of the present invention may include other microstructure components than the above described ones such that the total area fraction of the other microstructure components is 5% or less. Examples of the other microstructure components include pearlite.

Average Crystal Grain Size of Martensite Included in Region Extending 50 μm from Surface of Steel Sheet: 20 μm or Less The region in which microcracks are formed in a bending work is primarily the region extending 50 μm from the surface of the steel sheet (hereinafter, this region may be referred to as "surface layer" or "surface layer of the steel sheet"). When the average crystal grain size of martensite included in the region extending 50 μm from the surface of the steel sheet is 20 μm or less, the formation of microcracks in a bending work may be reduced and the bendability required in accordance with aspects of the present invention may be achieved. Accordingly, the average crystal grain size of martensite included in the region extending 50 μm from the surface of the steel sheet is limited to be 20 μm or less. Although the lower limit is not specified, the above average crystal grain size is commonly 1 μm or more.

In accordance with aspects of the present invention, the oxide particles dispersed in the surface layer of the steel sheet and the trapped hydrogen play an important role, and excellent bendability may be achieved when the above factors are controlled to fall within predetermined ranges. Although the mechanisms for this are not clarified, it is considered that, for example, when hydrogen is trapped by oxide particles included in the surface layer of the steel sheet, microvoids are likely to be formed in a bending work as a result of separation between the oxide particles and the base iron, which may cause plastic relaxation and reduce the formation of macro cracks.

Oxide Particles Having Minor Axis Length of 0.8 μm or Less in Region Extending 50 μm from Surface of Steel Sheet: $1.0\times10^{10}$ Particles/$m^2$ or More Coarse Oxide Particles Having Minor Axis Length of More Than 1.0 μm in Region Extending 50 μm from Surface of Steel Sheet: $1.0\times10^{8}$ Particles/$m^2$ or Less If the content of oxide particles having a minor axis length of 0.8 μm or less in the region extending 50 μm from the surface of the steel sheet is less than $1.0\times10^{10}$ particles/$m^2$, the bendability required in accordance with aspects of the present invention may fail to be achieved. If the content of oxide particles having a minor axis length of more than 1.0 μm in the above region is more than $1.0\times10^{8}$ particles/$m^2$, the bendability of the steel sheet may become degraded. Accordingly, the content of the oxide particles in the region extending 50 μm from the surface of the steel sheet is limited to be $1.0\times10^{10}$ particles/$m^2$ or more and is preferably $100.0\times10^{10}$ particles/$m^2$ or more. The content of oxide particles having a minor axis length of more than 1.0 μm is limited to be $1.0\times10^{8}$ particles/$m^2$ or less and is more preferably $1.0\times10^{7}$ particles/$m^2$ or less. In the case where a coating film is present on the surface of the steel sheet, the interface between the base iron and the coating film is considered as the surface of the steel sheet. In accordance with aspects of the present invention, the term "oxide" refers primarily to a simple or complex oxide of Fe, Si, Mn, Al, Mg, Ti, or the like. The upper limit is not specified and is commonly $500.0\times10^{10}$ particles/$m^2$ or less. Oxide particles having a minor axis length of more than 0.8 μm and less than 1.0 μm which are included in the region extending 50 μm from the surface of the steel sheet do not greatly affect the advantageous effects according to aspects of the present invention.

Hydrogen Trapped in Steel Sheet: 0.05 ppm by Mass or More

If the content of hydrogen trapped in the steel sheet is less than 0.05 ppm by mass, the bendability required in accordance with aspects of the present invention may fail to be achieved. Accordingly, the content of hydrogen trapped in the steel sheet is limited to be 0.05 ppm by mass or more and is preferably 0.07 ppm by mass or more. In accordance with aspects of the present invention, the term "trapped hydrogen" refers to hydrogen that is desorbed at 350° C. or more when thermal desorption is performed in the increasing temperature at 200° C./hr. It is particularly preferable to limit the content of hydrogen that desorbs at 350° C. to 600° C. to be 0.05 ppm by mass or more. It is more preferable to limit the content of hydrogen that desorbs at 450° C. to 600° C. to be 0.05 ppm by mass or more. Although the upper limit is not specified, the content of hydrogen trapped in the steel sheet is commonly 1.00 ppm by mass or less. It is necessary to limit the content of hydrogen trapped in the steel sheet to be 0.05 ppm by mass or more prior to a bending work. However, even in a product that has been subjected to a bending work, when the content of hydrogen trapped in the steel sheet which is measured at an unbent portion of the steel sheet is 0.05 ppm by mass or more, it is considered that the content of hydrogen trapped in the steel sheet at the bent portion of steel sheet was 0.05 ppm by mass or more.

In accordance with aspects of the present invention, the area fraction of a microstructure component is the ratio of the area of the microstructure component to the area of observation. The area fractions of microstructure components are determined by taking a sample from an annealed steel sheet, grinding and polishing a cross section of the sample, the cross section being taken in the thickness direction of the steel sheet so as to be parallel to the rolling direction, performing etching with 3% nital, capturing an image of the cross section in the vicinity of the surface and at a position 300 μm from the surface in the thickness direction with a SEM (scanning electron microscope) at 1500-fold magnification in 3 fields of view for each position, calculating the area fractions of the microstructure components with Image-Pro produced by Media Cybernetics, Inc. on the basis of the image data, and calculating the average of the area fractions of each of the microstructure components in the fields of view as the area fraction of the microstructure component. In the image data, ferrite is identified as black that does not contain carbides; upper bainite is identified as gray or dark gray that does not contain uniformly aligned carbide particles; retained austenite is identified as white or light gray; lower bainite is identified as gray or dark gray that contains uniformly aligned carbide particles; martensite is identified as white, or light gray, gray, or dark gray that contains carbides having a plurality of orientations; and pearlite is identified as a black and white lamellar microstructure. Carbide is identified as a dot-like or linear white microstructure. Note that, in accordance with aspects of the present invention, although plural types of martensite having different properties may exist depending on the tempering conditions as described above, the plural types of martensite formed under different tempering conditions are not distinguished from one another and collectively considered as martensite.

Since ferrite can be identified as black that does not contain carbides as described above, the area fraction of elongated ferrite phase grains having an aspect ratio of 3 or more can be determined from the above image data.

The area fraction of retained austenite phase can be determined by grinding the steel sheet that has been subjected to the final production step to a position ¼ the thickness of the steel sheet, further polishing the resulting cross section by 0.1 mm by chemical polishing, measuring the integrated diffraction intensities on the (200), (220), and (311) planes of fcc iron (austenite phase) and the (200 plane), the (211) plane, and the (220) plane of bcc iron (ferrite phase) with an X-ray diffraction apparatus using Mo-Kα radiation, and determining the volume fraction of retained austenite phase on the basis of the ratio of the integrated diffraction intensities measured on the above planes of fcc iron (austenite phase) to the integrated diffraction intensities measured on the above planes of bcc iron (ferrite phase). The above volume fraction is used as the area fraction of retained austenite phase. In accordance with aspects of the present invention, the area fraction of retained austenite phase was determined by the above-described method in which X-ray diffraction is used.

As for the oxide included in the surface layer of the steel sheet, the above sample is etched with 0.05% nital, an image of a region which extends 50 μm from the surface layer of the steel sheet is captured with a SEM at 5000-fold magnification in 10 fields of view on a random basis, and the number of oxide particles having a minor axis length of 0.8 μm or less and whether oxide particles having a minor axis length of more than 0.8 μm are present are determined with Image-Pro produced by Media Cybernetics, Inc. on the basis of the image data. In the image data, oxide particles can be identified as dot-like or linear white portions. The average crystal grain size of martensite included in the surface layer of the steel sheet is also calculated using the above image data of the surface layer. Specifically, the average crystal grain size of martensite is determined by calculating the areas of martensite grains from the image data, calculating the equivalent circle diameters from the above areas as the crystal grain sizes of the martensite grains, and taking the number-average thereof. In the calculation of the average crystal grain size of martensite, the grain boundaries of martensite include the boundaries between martensite grains and prior-austenite grains or grains of other microstructure components and do not include packet boundaries and block boundaries.

The high-strength steel sheet according to aspects of the present invention that has the above-described composition, the above-described microstructure, etc. has a tensile strength (TS) of 980 MPa or more. Although the upper limit for the TS is not specified, the TS is preferably 2200 MPa or less in consideration of the balance between the TS and the other properties. The method for measuring the TS is as described in Examples below, that is, a method in which a JIS No. 5 tensile test specimen (JIS Z 2201) is taken from the steel sheet in a direction perpendicular to the rolling direction and the specimen is subjected to a tensile test conforming to JIS Z 2241 (1998) with a strain rate of $10^{-3}$/s.

The high-strength steel sheet according to aspects of the present invention has excellent bendability. Specifically, the ratio (R/t) of the minimum bend radius R determined by the following method to the thickness t of the steel sheet is 1.5 or less when the TS is 980 MPa or more and less than 1180 MPa, 2.5 or less when the TS is 1180 MPa or more and less than 1320 MPa, 3.5 or less when the TS is 1320 MPa or more and less than 1600 MPa, and 5.0 or less when the TS is 1600 MPa or more and less than 2100 MPa.

(Method for Measuring Bend Radius)

A strip-shaped test specimen having a width of 30 mm and a length of 100 mm is taken from the steel sheet such that the axis about which a bend test is conducted is parallel to the rolling direction. This specimen is subjected to a bend test. Specifically, the test specimen is subjected to a 90°-V bend test with a stroke speed of 50 mm/s, a pressing load of 10 ton, and a press holding time of 5 seconds. The ridge line formed at the vertex of the bent portion is observed with a 10-fold magnifier. The minimum one of bend radius at which cracks having a length of 0.5 mm or more are not formed is determined.

The high-strength steel sheet according to aspects of the present invention may include a coating film constituted by one or more layers which is disposed on the surface. Examples of the coating film include an organic coating film, an inorganic coating film, and an inorganic-organic composite coating film. When the high-strength steel sheet includes the coating film, corrosion resistance, a rust prevention property, resistance to delayed fracture, design, lubricity, an antibacterial property, and the like may be enhanced.

The high-strength steel sheet according to aspects of the present invention may include a coated layer disposed on the surface. Examples of the coated layer include a hot-dip galvanizing layer, an electrogalvanizing layer, and a hot-dip aluminizing layer. The coated layer may be an alloyed hot-dip galvanizing layer produced by performing an alloying treatment subsequent to hot-dip galvanizing.

Production Method

A method for producing the high-strength steel sheet according to aspects of the present invention includes a hot-rolling step of heating a slab having the above-described composition, rough-rolling the slab, subsequently performing descaling at a pressure of 15 MPa or more, then performing finish rolling at 800° C. to 950° C., performing cooling subsequent to the finish rolling, and then performing coiling at 550° C. or less to produce a hot-rolled steel sheet, an optional cold-rolling step of cold-rolling the hot-rolled steel sheet at a rolling reduction ratio of 20% or more to produce a cold-rolled steel sheet, an annealing step of heating the hot-rolled steel sheet or the cold-rolled steel sheet to 730° C. to 950° C. and performing holding at 730° C. to 950° C. in an atmosphere having a hydrogen concentration of 1.0% to 35.0% by volume and a dew point of −35° C. to 15° C. for 10 to 1000 s, a cooling step of cooling the annealed steel sheet to 600° C. at an average rate of 5° C./s or more, stopping the cooling at a temperature of more than Ms and 600° C. or less, subsequently performing retention at a temperature of more than Ms and 600° C. or less for 1000 s or less, and then performing cooling to room temperature such that the average cooling rate between Ms and 50° C. is 1.0° C./s or more, an elongation rolling step of rolling the steel sheet at an elongation ratio of 0.05% to 1%, and an aging treatment step of subjecting the steel sheet to an aging treatment under conditions satisfying the formula below, $$(273+T)\times(20+\log_{10}(t))\geq 6800,\ T\leq 200,$$

where T is a temperature (° C.) and t is a time (hr).

Descaling Pressure: 15 MPa or More

If the descaling pressure is less than 15 MPa, scales may remain on the steel sheet and increase the likelihood of coarse oxide particles being formed in the surface layer of the steel sheet by feeding oxygen while cooling is performed subsequent to coiling. This results in degradation of bendability. Accordingly, the descaling pressure is limited to be 15 MPa or more. Although the upper limit is not specified, the descaling pressure is preferably 75 MPa or less.

Finish-Rolling Temperature: 800° C. to 950° C.

If the finish-rolling temperature is less than 800° C., ferrite may be formed and elongated ferrite grains may be formed in the surface layer of the hot-rolled steel sheet. The ferrite grains remain in the surface layer even after annealing to form elongated ferrite grains having an aspect ratio of 3 or more, which degrade the bendability of the steel sheet. If the finish-rolling temperature is more than 950° C., the average grain size of martensite included in the surface layer may be increased, which degrades the bendability of the steel sheet. Accordingly, the finish-rolling temperature is limited to be 800° C. to 950° C. As for the lower limit, the finish-rolling temperature is preferably 830° C. or more. As for the upper limit, the finish-rolling temperature is preferably 920° C. or less.

Coiling Temperature: 550° C. or Less

If the coiling temperature is more than 550° C., oxide particles having a minor axis length of more than 0.8 μm may be formed in the surface layer of the steel sheet and, consequently, the bendability required in accordance with aspects of the present invention may fail to be achieved. Accordingly, the coiling temperature is limited to be 550° C. or less and is preferably 500° C. or less. Although the lower limit is not specified, the coiling temperature is preferably 250° C. or more in consideration of shape stability and the like.

Cold Rolling Reduction Ratio: 20% or More

Cold rolling is not necessarily performed. When cold rolling is performed in accordance with aspects of the present invention, the rolling reduction ratio needs to be 20% or more. If the rolling reduction ratio is less than 20%, coarse elongated ferrite grains may be formed during annealing, which results in the degradation of bendability. Accordingly, when cold rolling is performed, the rolling reduction ratio is limited to be 20% or more and is preferably 30% or more. Although the upper limit is not specified, the rolling reduction ratio is preferably 90% or less in consideration of shape stability and the like.

Annealing Temperature: 730° C. to 950° C.

In the case where cold rolling is not performed, the hot-rolled steel sheet is annealed. In the case where cold rolling is performed, the cold-rolled steel sheet is annealed. If the annealing temperature is less than 730° C., the formation of austenite may become insufficient. Since austenite formed by annealing is converted into martensite or bainite in the final microstructure by bainite transformation or martensite transformation, insufficient formation of austenite results in failure to achieve the intended microstructure. If the annealing temperature exceeds 950° C., coarse grains may be formed. In such a case, the intended microstructure may also fail to be achieved. Accordingly, the annealing temperature is limited to be 730° C. to 950° C. As for the lower limit, the annealing temperature is preferably 750° C. or more. As for the upper limit, the annealing temperature is preferably 930° C. or less.

Annealing Holding Time: 10 to 1000 s

If the annealing holding time is less than 10 s, the formation of austenite may become insufficient and, consequently, the intended microstructure or the intended amount of trapped hydrogen may fail to be achieved. If the annealing holding time exceeds 1000 s, coarse grains may be formed and, consequently, the intended microstructure according to aspects of the present invention may fail to be achieved. Accordingly, the annealing holding time is limited to be 10 to 1000 s. As for the lower limit, the annealing holding time is preferably 30 s or more. As for the upper limit, the annealing holding time is preferably 500 s or less. In accordance with aspects of the present invention, the term "annealing holding time" refers to the amount of time during which the steel sheet is retained in an annealing temperature range described above. The temperature is not necessarily maintained to be constant; the temperature may be increased or reduced within a range of 730° C. to 950° C.

Hydrogen Concentration in Atmosphere at 730° C. to 950° C.: 1.0% to 35.0% by Volume If the hydrogen concentration in the atmosphere at 730° C. to 950° C. is less than 1.0% by volume, the intended amount of trapped hydrogen may fail to be achieved. If the above hydrogen concentration is more than 35.0% by volume, the risk of the steel sheet rupturing in the operation due to hydrogen embrittlement may be increased. Accordingly, the hydrogen concentration in the atmosphere at 730° C. to 950° C. is limited to be 1.0% to 35.0% by volume. As for the lower limit, the above hydrogen concentration is preferably 4.0% by volume or more. As for the upper limit, the above hydrogen concentration is preferably 32.0% by volume or less.

Dew Point at 730° C. to 950° C.: −35° C. to 15° C.

If the dew point at 730° C. to 950° C. is less than −35° C., internal oxidation may fail to occur to a sufficient degree. If the above dew point is more than 15° C., pick-up may be formed and degrade the consistency in the operation. Accordingly, the dew point at 730° C. to 950° C. is limited to be −35° C. to 15° C. As for the lower limit, the above dew point is preferably −30° C. or more. As for the upper limit, the above dew point is preferably 5° C. or less.

Average Cooling Rate Between Annealing Temperature and 600° C.: 5° C./s or More

If the average cooling rate between the annealing temperature and 600° C. is less than 5° C./s, polygonal ferrite may be formed in an excessive amount and, consequently, the microstructure according to aspects of the present invention may fail to be formed. Accordingly, the average cooling rate between the annealing temperature and 600° C. is limited to be 5° C./s or more and is preferably 8° C./s or more. Although the upper limit is not specified, the above average cooling rate is preferably 1500° C./s or less.

Cooling Stop Temperature: More than Ms and 600° C. or Less

If the cooling stop temperature is Ms or less, tempered martensite may be formed, which results in a reduction in TS and the degradation of bendability. If the cooling stop temperature is more than 600° C., polygonal ferrite may be formed in an excessive amount and, consequently, the intended microstructure may fail to be formed. Accordingly, the cooling stop temperature is limited to be more than Ms and 600° C. or less. As for the lower limit, the cooling stop temperature is preferably 440° C. or more. As for the upper limit, the cooling stop temperature is preferably 560° C. or less.

Retention Time at Ms to 600° C.: 1000 s or Less

If the retention time at Ms to 600° C. is more than 1000 s, the ferrite transformation and the bainite transformation may occur to an excessive degree or pearlite may be formed in an excessive amount and, consequently, the intended microstructure may fail to be formed. In addition, the amount of the trapped hydrogen may be reduced and, consequently, the bendability of the steel sheet may become degraded. Accordingly, the retention time at Ms to 600° C. is limited to be 1000 s or less, is preferably 500 s or less, and is more preferably 200 s or less. As for the lower limit, the above retention time is preferably 5 s or more and is more preferably 10 s or more. Optionally, subsequent to a cooling, the temperature may be increased to the intended temperature prior to the retention.

Temperature Range of Ms to 50° C.: 1.0° C./s or More

If the average cooling rate between Ms and 50° C. is less than 1.0° C./s, hydrogen may become dissipated and, consequently, the intended amount of the trapped hydrogen may fail to be achieved. Accordingly, the average cooling rate between Ms and 50° C. is limited to be 1.0° C./s or more. As for the upper limit, the above average cooling rate is preferably 1500° C./s or less. The cooling stop temperature in the cooling step is room temperature. The term "room temperature" used herein refers to a temperature of 15° C. to 25° C.

Elongation Ratio in Elongation Rolling (Temper Rolling): 0.05% to 1%

If the elongation ratio in elongation rolling is less than 0.05%, the intended amount of the trapped hydrogen may fail to be achieved. If the above elongation ratio is more than 1%, the oxide particles included in the surface layer may become detached. Accordingly, the elongation ratio in elongation rolling is limited to be 0.05% to 1%. As for the lower limit, the above elongation ratio is preferably 0.10% or more. As for the upper limit, the above elongation ratio is preferably 0.7% or less and is more preferably 0.5% or less.

Aging Treatment Subsequent to Elongation Rolling: $(273+T)\times(20+\log_{10}(t))\geq 6800$, $T\leq 200$, where T is Temperature (° C.) and t is Time (hr)

When the conditions under which the aging treatment is performed subsequent to the elongation rolling satisfy the above relationship, hydrogen may be trapped by the oxide included in the steel and, consequently, the intended amount of the trapped hydrogen may be achieved. If the above conditions deviate from the relationship, the state in which hydrogen is trapped by the oxide may change and, consequently, the bendability required in accordance with aspects of the present invention may fail to be achieved. Accordingly, the aging treatment performed subsequent to the elongation rolling satisfies $(273+T)\times(20+\log_{10}(t))\geq 6800$, $T\leq 200$, where T is a temperature (° C.) and t is a time (hr).

Although the other conditions for the production method are not limited, for example, the following conditions are preferably employed.

The slab is preferably produced by continuous casting in order to prevent macrosegregation. Ingot casting and thin-slab casting may alternatively be used for preparing the slab. When the slab is hot-rolled, the slab may be cooled to room temperature and subsequently reheated prior to the hot rolling. In another case, the slab may be charged into a heating furnace without being cooled to room temperature before hot rolling. Alternatively, an energy-saving process in which the slab is hot-rolled immediately after heat insulation has been performed simply also be used. When the slab is heated, it is preferable to heat the slab to 1100° C. or more in order to dissolve carbide and prevent an increase in the rolling load. The slab-heating temperature is preferably 1300° C. or less in order to prevent an increase in scale loss. Note that, the temperature of the slab refers to the temperature of the surface of the slab. Heating rough-rolled steel bars may be performed in hot-rolling of the slab. Alternatively, rough-rolled steel bars joined to one another may be subjected to continuous finish rolling. That is, a "continuous rolling process" may be used. It is preferable to perform, in hot rolling, lubricated rolling with a coefficient of friction of 0.10 to 0.25 in all or a part of the passes of the finish rolling in order to reduce the rolling load and variations in shape and quality of the steel sheet.

Subsequent to the coiling, scale is removed from the steel sheet by pickling or the like. Then, annealing and hot-dip galvanizing are performed. Some of the hot-rolled steel sheets may be cold-rolled prior to annealing.

Optionally, a coating film formation treatment may be performed in any of the steps subsequent to the annealing step. Examples of the coating film formation treatment include a treatment in which roller coating, electrodeposition, immersion, or the like is performed.

In the case where the method for producing the high-strength steel sheet according to aspects of the present invention is a method for producing the high-strength steel sheet that includes a coated layer disposed on the surface, the production method according to aspects of the present invention further includes a plating process performed in the cooling step.

The method for the plating process may be a common method appropriate to the coated layer that is to be formed. In the case where a hot-dip galvanizing treatment is performed, an alloying treatment may be performed.

EXAMPLES

The present invention is specifically described on the basis of Examples below. The scope of the present invention is not limited to Examples below.

Steels having the compositions described in Table 1 (the balance being Fe and inevitable impurities) were prepared in a vacuum melting furnace placed in a laboratory and rolled into steel slabs. The steel slabs were heated to 1200° C. and then rough-rolled. The rough-rolled steel sheets were hot-rolled under the conditions described in Table 2-1 to form hot-rolled steel sheets (HR). Some of the hot-rolled steel sheets were cold-rolled to a thickness of 1.4 mm to form cold-rolled steel sheets (CR). The hot-rolled steel sheets and the cold-rolled steel sheets were annealed. The annealing treatment was performed by heating treatment in a laboratory. For some of the samples, a plating apparatus was further used. The treatment was performed under the conditions described in Tables 2-1 and 2-2. Hereby, cold-rolled steel sheets (CR), hot-dip galvanized steel sheets (GI), and alloyed hot-dip galvanized steel sheets (GA) 1 to 34 were prepared. The hot-dip galvanized steel sheets were prepared by immersing the steel sheets in a plating bath having a temperature of 465° C. to form a coated layer at a coating weight of 35 to 45 g/m$^2$. The alloyed galvanized steel sheets were prepared by performing an alloying treatment in which the steel sheets were held at 500° C. to 600° C. for 1 to 60 s subsequent to the formation of the coated layer. Subsequent to the plating process, the temperature was reduced to room temperature at 8° C./s.

The hot-dip galvanized steel sheets and the alloyed hot-dip galvanized steel sheets were subjected to elongation rolling (temper rolling) and an aging treatment and subsequently evaluated in terms of tensile properties and bendability in accordance with the following methods. Table 3 summarizes the results. Table 3 also summarizes the results of observation of the microstructures and the results of observation of the oxides included in the specific regions which were conducted by the above-described methods. In the item regarding the coarse oxide particles, "Absent" is shown when the content of coarse oxide particles having a minor axis length of more than 1.0 μm in the region extending 50 μm from the surface of the steel sheet is 1.0×10$^8$ particles/m$^2$ or less, while "Present" is shown when the content of coarse oxide particles having a minor axis length of more than 1.0 μm in the region extending 50 μm from the surface of the steel sheet is more than 1.0×10$^8$ particles/m$^2$.

<Tensile Test>

The TS of each of the annealed steel sheets was measured by taking a JIS No. 5 tensile test specimen (JIS Z 2201) from the annealed steel sheet in a direction perpendicular to the rolling direction and subjecting the specimen to a tensile test conforming to JIS Z 2241 (1998) with a strain rate of 10$^{-3}$/s. In accordance with aspects of the present invention, a sample having a TS of 980 MPa or more was considered acceptable.

<Bendability>

A strip-shaped test specimen having a width of 30 mm and a length of 100 mm was taken from each of the annealed steel sheets such that the axis about which a bend test was conducted was parallel to the rolling direction. This specimen was subjected to a bend test. Specifically, the test specimen was subjected to a 90°-V bend test with a stroke speed of 50 mm/s, a pressing load of 10 ton, and a press holding time of 5 seconds. The ridge line formed at the vertex of the bent portion was observed with a 10-fold magnifier. The minimum bend radius at which cracks having a length of 0.5 mm or more were not formed was determined. The ratio (R/t) of the minimum bend radius R to the thickness t of the steel sheet was calculated. The ratio (R/t) was used as a measure for the evaluation of bendability.

<Trapped Hydrogen Content>

A test specimen having a length of 30 mm and a width of 5 mm was taken from each of the annealed steel sheets. After the coated layer had been removed with an alkali, the content of the trapped hydrogen and the peak of desorption of hydrogen were measured. The above measurement was conducted by a thermal desorption method. The heating rate was set to 200° C./hr. Specifically, the temperature was increased from room temperature to 800° C. continuously and then reduced to room temperature. The temperature was again increased to 800° C. at a heating rate of 200° C./hr. The difference between the amount of hydrogen desorbed in the first heating and the amount of hydrogen desorbed in the second heating was considered as the amount of hydrogen desorbed, and part of the desorbed hydrogen which was detected at 350° C. to 600° C. was considered as trapped hydrogen. Table 3 summarizes the results.

TABLE 1

| | Composition (mass%) | | | | | | | | |
|---|---|---|---|---|---|---|---|---|---|
| Steel | C | Si | Mn | P | S | Al | N | Others | Remark |
| A | 0.10 | 0.60 | 2.5 | 0.012 | 0.0009 | 0.024 | 0.003 | — | Within the scope of invention |
| B | 0.15 | 0.15 | 3.5 | 0.015 | 0.0021 | 0.100 | 0.002 | — | Within the scope of invention |
| C | 0.10 | 1.40 | 2.5 | 0.020 | 0.0013 | 0.030 | 0.007 | Mo: 0.15, B: 0.0020 | Within the scope of invention |
| D | 0.15 | 0.40 | 3.5 | 0.025 | 0.0024 | 0.045 | 0.004 | Ti: 0.030, Nb: 0.010, B: 0.0010 | Within the scope of invention |
| E | 0.20 | 0.60 | 3.0 | 0.004 | 0.0045 | 0.017 | 0.003 | Cr: 0.50, Nb: 0.030, Mo: 0.10, B: 0.0020 | Within the scope of invention |
| F | 0.25 | 1.20 | 2.5 | 0.008 | 0.0005 | 0.029 | 0.005 | Ni: 0.5, Ti: 0.015, Mo: 0.10, REM: 0.0010 | Within the scope of invention |
| G | 0.32 | 0.90 | 3.0 | 0.015 | 0.0014 | 0.035 | 0.005 | Mo: 0.20, V: 0.10, Cu: 0.10, Ca: 0.0010 | Within the scope of invention |
| H | 0.10 | 0.30 | 3.0 | 0.014 | 0.0022 | 0.015 | 0.003 | Nb: 0.035, Cu: 0.10, B: 0.0020, Sb: 0.010 | Within the scope of invention |
| I | 0.37 | 1.80 | 3.5 | 0.013 | 0.0003 | 0.048 | 0.004 | Mo: 0.10, B: 0.0005, Sn: 0.05 | Within the scope of invention |
| J | 0.45 | 1.00 | 2.5 | 0.005 | 0.0011 | 0.034 | 0.003 | Ni: 0.30, Ti: 0.015, B: 0.0015, Sn: 0.05 | Outside the scope of invention |
| K | 0.04 | 0.50 | 3.0 | 0.018 | 0.0006 | 0.036 | 0.005 | Ti: 0.020, Mo: 0.25, B: 0.0020 | Outside the scope of invention |
| L | 0.15 | 0.05 | 2.5 | 0.015 | 0.0014 | 0.027 | 0.003 | Cr: 0.50, Nb: 0.030, Mo: 0.05, B: 0.0010 | Outside the scope of invention |

TABLE 1-continued

| Steel | Composition (mass%) | | | | | | | | Remark |
|---|---|---|---|---|---|---|---|---|---|
| | C | Si | Mn | P | S | Al | N | Others | |
| M | 0.15 | 3.50 | 3.5 | 0.013 | 0.0019 | 0.025 | 0.004 | Ni: 0.50, Ti: 0.020, V: 0.10, B: 0.0020 | Outside the scope of invention |
| N | 0.20 | 0.50 | 1.3 | 0.003 | 0.0030 | 0.036 | 0.005 | Ti: 0.020, Nb: 0.010, Mo: 0.20, B: 0.0020 | Outside the scope of invention |
| O | 0.15 | 1.00 | 4.1 | 0.012 | 0.0024 | 0.030 | 0.003 | Ti: 0.010, Nb: 0.010, Mo: 0.15 | Outside the scope of invention |

*The underlined values are outside the scope of the present invention.

TABLE 2-1

| | | Hot rolling | | | Cold rolling | Annealing | | | | | | | | | |
|---|---|---|---|---|---|---|---|---|---|---|---|---|---|---|---|
| | | | | | | | | Hydrogen | | | | | | | |
| Steel sheet No | Steel | Finish rolling temperature (° C.) | Descaling pressure (MPa) | Coiling temperature (° C.) | Cold rolling reduction ratio (%) | Annealing temperature (° C.) | Annealing holding time (s) | Dew point at 730° C. to 950° C. (° C.) | concentration at 730° C. to 950° C. (vol %) | Average cooling rate (° C./s) | Cooling stop temperature (° C.) | Average heating rate (° C./s) | Retention temperature (° C.) | Retention time (s) | Remark |
| 1 | A | 900 | 50 | 500 | 50 | 810 | 200 | −20 | 10 | 15 | 500 | — | 500 | 60 | Invention example |
| 2 | | 980 | 50 | 500 | 50 | 810 | 200 | −20 | 10 | 15 | 500 | — | 500 | 60 | Comparative example |
| 3 | | 750 | 50 | 500 | 50 | 810 | 200 | −20 | 10 | 15 | 500 | — | 500 | 60 | Comparative example |
| 4 | | 900 | 50 | 600 | 50 | 810 | 200 | −20 | 10 | 15 | 500 | — | 500 | 60 | Comparative example |
| 5 | | 900 | 50 | 500 | 15 | 810 | 200 | −20 | 10 | 15 | 500 | — | 500 | 60 | Comparative example |
| 6 | B | 900 | 30 | 500 | 50 | 900 | 100 | −25 | 15 | 30 | 500 | — | 500 | 180 | Invention example |
| 7 | | 900 | 30 | 500 | 50 | 980 | 100 | −25 | 15 | 30 | 500 | — | 500 | 180 | Comparative example |
| 8 | | 900 | 30 | 500 | 50 | 900 | 1200 | −25 | 15 | 30 | 500 | — | 500 | 180 | Comparative example |
| 9 | | 900 | 30 | 500 | 50 | 900 | 1 | −25 | 15 | 30 | 500 | — | 500 | 180 | Comparative example |
| 10 | | 900 | 30 | 500 | 50 | 850 | 100 | −25 | 15 | 1000 | 25 | 100 | 150 | 180 | Invention example |
| 11 | C | 900 | 15 | 450 | 40 | 810 | 600 | −35 | 5 | 10 | 200 | 30 | 400 | 480 | Invention example |
| 12 | | 900 | 15 | 450 | 40 | 700 | 600 | −35 | 5 | 10 | 200 | 30 | 400 | 480 | Comparative example |
| 13 | | 900 | 15 | 450 | 40 | 810 | 600 | −35 | 5 | 4 | 200 | 30 | 400 | 480 | Comparative example |
| 14 | | 900 | 15 | 450 | 40 | 810 | 600 | −35 | 5 | 10 | 620 | — | 620 | 480 | Comparative example |
| 15 | D | 900 | 30 | 400 | — | 830 | 200 | −30 | 2 | 20 | 200 | — | 200 | 100 | Invention example |
| 16 | | 900 | 30 | 400 | — | 830 | 200 | −30 | 0.5 | 20 | 200 | — | 200 | 100 | Comparative example |
| 17 | | 900 | 30 | 400 | — | 830 | 200 | −40 | 2 | 20 | 200 | — | 200 | 100 | Comparative example |
| 18 | | 900 | 30 | 400 | — | 830 | 200 | −30 | 2 | 20 | 200 | — | 200 | 100 | Comparative example |
| 19 | | 900 | 30 | 400 | — | 830 | 200 | −30 | 2 | 20 | 200 | — | 200 | 1150 | Comparative example |
| 20 | E | 850 | 30 | 500 | 50 | 880 | 200 | −15 | 20 | 50 | 460 | — | 460 | 50 | Invention example |
| 21 | | 850 | 30 | 500 | 50 | 880 | 200 | −15 | 20 | 50 | 460 | — | 460 | 50 | Comparative example |
| 22 | | 850 | 10 | 500 | 50 | 880 | 200 | −15 | 20 | 50 | 460 | — | 460 | 50 | Comparative example |
| 23 | | 850 | 30 | 500 | 50 | 880 | 200 | −15 | 20 | 50 | 460 | — | 460 | 50 | Comparative example |
| 24 | | 850 | 30 | 500 | 50 | 880 | 200 | −15 | 20 | 50 | 460 | — | 460 | 50 | Comparative example |
| 25 | F | 900 | 30 | 500 | 50 | 850 | 200 | −10 | 25 | 15 | 550 | — | 550 | 30 | Invention example |
| 26 | G | 900 | 30 | 500 | 50 | 750 | 800 | −5 | 30 | 15 | 500 | — | 500 | 10 | Invention example |
| 27 | H | 900 | 30 | 500 | 50 | 810 | 200 | 0 | 20 | 15 | 500 | — | 500 | 80 | Invention example |
| 28 | I | 900 | 30 | 500 | 50 | 850 | 200 | 5 | 25 | 15 | 500 | — | 500 | 80 | Invention example |
| 29 | J | 900 | 30 | 500 | 50 | 810 | 200 | 10 | 25 | 15 | 500 | — | 500 | 80 | Comparative example |
| 30 | K | 900 | 30 | 500 | 50 | 810 | 200 | −5 | 10 | 15 | 500 | — | 500 | 80 | Comparative example |
| 31 | L | 900 | 30 | 500 | 50 | 810 | 200 | −5 | 10 | 15 | 500 | — | 500 | 80 | Comparative example |
| 32 | M | 900 | 30 | 500 | 50 | 890 | 200 | −5 | 10 | 15 | 500 | — | 500 | 80 | Comparative example |
| 33 | N | 900 | 30 | 500 | 50 | 810 | 200 | −5 | 10 | 15 | 500 | — | 500 | 80 | Comparative example |
| 34 | O | 900 | 30 | 500 | 50 | 810 | 200 | −5 | 10 | 15 | 500 | — | 500 | 80 | Comparative example |

TABLE 2-2

| Steel sheet No. | Galvanization: Plating bath temperature (° C.) | Galvanization: Alloying temperature (° C.) | Galvanization: Alloying holding time (s) | Average cooling rate between Ms and 50° C. (° C./s) | Elongation ratio (%) | Aging temperature (° C.) | Aging time (hr) | Formula (1) | *Surface condition | Remark |
|---|---|---|---|---|---|---|---|---|---|---|
| 1 | — | — | — | 20 | 0.3 | 25 | 1200 | 6878 | CR | Invention example |
| 2 | — | — | — | 20 | 0.3 | 25 | 1200 | 6878 | CR | Comparative example |
| 3 | — | — | — | 20 | 0.3 | 25 | 1200 | 6878 | CR | Comparative example |
| 4 | — | — | — | 20 | 0.3 | 25 | 1200 | 6878 | CR | Comparative example |
| 5 | — | — | — | 20 | 0.3 | 25 | 1200 | 6878 | CR | Comparative example |
| 6 | 465 | — | — | 50 | 0.6 | 100 | 240 | 8348 | GI | Invention example |
| 7 | 465 | — | — | 50 | 0.6 | 100 | 240 | 8348 | GI | Comparative example |
| 8 | 465 | — | — | 50 | 0.6 | 100 | 240 | 8348 | GI | Comparative example |
| 9 | 465 | — | — | 50 | 0.6 | 100 | 240 | 8348 | GI | Comparative example |
| 10 | — | — | — | 1000 | 0.6 | 100 | 240 | 8348 | CR | Invention example |
| 11 | — | — | — | 5 | 0.3 | 50 | 720 | 7383 | CR | Invention example |
| 12 | — | — | — | 5 | 0.3 | 50 | 720 | 7383 | CR | Comparative example |
| 13 | — | — | — | 5 | 0.3 | 50 | 720 | 7383 | CR | Comparative example |
| 14 | — | - — | — | 5 | 0.3 | 50 | 720 | 7383 | CR | Comparative example |
| 15 | 465 | 520 | 20 | 20 | 0.3 | 75 | 120 | 7684 | GA | Invention example |
| 16 | 465 | 520 | 20 | 20 | 0.3 | 75 | 120 | 7684 | GA | Comparative example |
| 17 | 465 | 520 | 20 | 20 | 0.3 | 75 | 120 | 7684 | GA | Comparative example |
| 18 | 465 | 520 | 20 | 20 | 0 | 75 | 120 | 7684 | GA | Comparative example |
| 19 | 465 | 520 | 20 | 20 | 0.3 | 75 | 120 | 7684 | GA | Comparative example |
| 20 | 465 | 520 | 20 | 10 | 0.6 | 50 | 1200 | 7455 | GA | Invention example |
| 21 | 465 | 520 | 20 | 0.5 | 0.6 | 50 | 1200 | 7455 | GA | Comparative example |
| 22 | 465 | 520 | 20 | 10 | 0.6 | 50 | 1200 | 7455 | GA | Comparative example |
| 23 | 465 | 520 | 20 | 10 | 0.6 | 250 | 1 | 10460 | GA | Comparative example |
| 24 | 465 | 520 | 20 | 10 | 0.6 | 25 | 480 | 6759 | GA | Comparative example |
| 25 | 465 | — | — | 20 | 0.1 | 180 | 0.1 | 8607 | GI | Invention example |
| 26 | 465 | 520 | 20 | 20 | 0.1 | 200 | 1 | 9460 | GA | Invention example |
| 27 | 465 | 520 | 20 | 20 | 1.0 | 25 | 1200 | 6878 | GA | Invention example |
| 28 | 465 | 560 | 20 | 20 | 0.3 | 200 | 10 | 9933 | GA | Invention example |
| 29 | 465 | 520 | 20 | 20 | 0.3 | 25 | 2160 | 6954 | GA | Comparative example |
| 30 | 465 | 520 | 20 | 20 | 0.3 | 25 | 1440 | 6901 | GA | Comparative example |
| 31 | 465 | 520 | 20 | 20 | 0.3 | 25 | 1440 | 6901 | GA | Comparative example |
| 32 | 465 | 580 | 20 | 20 | 0.3 | 25 | 1440 | 6901 | GA | Comparative example |
| 33 | 465 | 520 | 20 | 20 | 0.3 | 25 | 1440 | 6901 | GA | Comparative example |
| 34 | 465 | 520 | 20 | 20 | 0.3 | 25 | 1440 | 6901 | GA | Comparative example |

*Surface condition CR: Cold-rolled steel sheet, GI: Hot-dip galvanized steel sheet, GA: Alloyed hot dip galvanized steel sheet

*The underlined values are outside the scope of the present invention.

TABLE 3

| Steel sheet No. | *Microstructure: V(H) (%) | V(M) (%) | V(γ) (%) | Others V(P) (%) | V(S) (%) | V(Fs) (%) | D(M) (μm) | *1 ($10^{10}$ Particles/$m^2$) | * 2 | Content of hydrogen trapped in steel sheet (ppm by mass) | Mechanical properties: TS (MPa) | R/t | Remark |
|---|---|---|---|---|---|---|---|---|---|---|---|---|---|
| 1 | 49 | 38 | 2 | 0 | 51 | 0 | 2 | 56 | Absent | 0.31 | 1000 | 0.4 | Invention example |
| 2 | 52 | 38 | 3 | 0 | 48 | 0 | 22 | 53 | Absent | 0.30 | 992 | 2.5 | Comparative example |
| 3 | 50 | 39 | 1 | 0 | 50 | 3 | 3 | 53 | Absent | 0.33 | 1007 | 2.1 | Comparative example |
| 4 | 44 | 36 | 2 | 0 | 56 | 0 | 8 | 92 | Present | 0.36 | 988 | 2.1 | Comparative example |
| 5 | 52 | 38 | 1 | 0 | 48 | 7 | 3 | 50 | Absent | 0.31 | 1039 | 2.5 | Comparative example |
| 6 | 100 | 96 | 4 | 0 | 0 | 0 | 16 | 13 | Absent | 0.11 | 1394 | 3.2 | Invention example |
| 7 | 100 | 96 | 4 | 0 | 0 | 0 | 28 | 10 | Absent | 0.09 | 1330 | 4.3 | Comparative example |
| 8 | 100 | 97 | 3 | 0 | 0 | 0 | 21 | 14 | Absent | 0.12 | 1384 | 3.6 | Comparative example |
| 9 | 82 | 82 | 0 | 0 | 18 | 0 | 11 | 12 | Absent | 0.02 | 1388 | 4.3 | Comparative example |
| 10 | 100 | 99 | 1 | 0 | 0 | 0 | 11 | 11 | Absent | 0.10 | 1390 | 2.9 | Invention example |
| 11 | 52 | 3 | 3 | 0 | 48 | 0 | 1 | 150 | Absent | 0.49 | 1031 | 1.1 | Invention example |
| 12 | 17 | 15 | 1 | 0 | 83 | 0 | 1 | 140 | Absent | 0.46 | 858 | 0.4 | Comparative example |
| 13 | 27 | 26 | 1 | 0 | 73 | 0 | 1 | 150 | Absent | 0.48 | 946 | 0.4 | Comparative example |
| 14 | 26 | 25 | 1 | 3 | 71 | 0 | 5 | 180 | Absent | 0.50 | 963 | 0.7 | Comparative example |
| 15 | 97 | 93 | 4 | 0 | 3 | 0 | 6 | 72 | Absent | 0.35 | 1365 | 2.9 | Invention example |
| 16 | 98 | 93 | 5 | 0 | 2 | 0 | 5 | 70 | Absent | 0.03 | 1374 | 3.6 | Comparative example |
| 17 | 97 | 92 | 5 | 0 | 3 | 0 | 5 | 0.7 | Absent | 0.03 | 1360 | 3.6 | Comparative example |
| 18 | 97 | 92 | 5 | 0 | 3 | 0 | 5 | 73 | Absent | 0.02 | 1368 | 3.6 | Comparative example |
| 19 | 97 | 93 | 4 | 0 | 3 | 0 | 6 | 70 | Absent | 0.02 | 1357 | 3.9 | Comparative example |
| 20 | 100 | 95 | 5 | 0 | 0 | 0 | 7 | 100 | Absent | 0.37 | 1568 | 3.2 | Invention example |
| 21 | 100 | 82 | 10 | 0 | 0 | 0 | 8 | 110 | Absent | 0.04 | 1523 | 4.3 | Comparative example |

TABLE 3-continued

| Steel sheet No. | *Microstructure V(H) (%) | V(M) (%) | V(γ) (%) | Others V(P) (%) | V(S) (%) | V(Fs) (%) | D(M) (μm) | *1 ($10^{10}$ Particles/$m^2$) | * 2 | Content of hydrogen trapped in steel sheet (ppm by mass) | Mechanical properties TS (MPa) | R/t | Remark |
|---|---|---|---|---|---|---|---|---|---|---|---|---|---|
| 22 | 100 | 94 | 6 | 0 | 0 | 0 | 7 | 110 | Present | 0.15 | 1562 | 3.9 | Comparative example |
| 23 | 99 | 96 | 3 | 1 | 0 | 0 | 8 | 96 | Absent | 0.03 | 1488 | 4.3 | Comparative example |
| 24 | 100 | 95 | 5 | 0 | 0 | 0 | 7 | 110 | Absent | 0.04 | 1564 | 4.3 | Comparative example |
| 25 | 100 | 93 | 7 | 0 | 0 | 0 | 11 | 130 | Absent | 0.50 | 1695 | 3.2 | Invention example |
| 26 | 92 | 80 | 12 | 0 | 8 | 0 | 12 | 100 | Absent | 0.45 | 1924 | 4.3 | Invention example |
| 27 | 91 | 85 | 3 | 0 | 9 | 0 | 8 | 45 | Absent | 0.22 | 1078 | 1.4 | Invention example |
| 28 | 100 | 87 | 13 | 0 | 0 | 0 | 13 | 120 | Absent | 0.61 | 2081 | 5.0 | Invention example |
| 29 | 97 | 79 | 15 | 0 | 3 | 0 | 15 | 90 | Absent | 0.41 | 2220 | 7.1 | Comparative example |
| 30 | 65 | 45 | 4 | 0 | 35 | 0 | 4 | 85 | Absent | 0.34 | 883 | 0.2 | Comparative example |
| 31 | 97 | 92 | 1 | 0 | 3 | 0 | 7 | 0.7 | Absent | 0.03 | 1326 | 3.9 | Comparative example |
| 32 | 100 | 93 | 7 | 0 | 0 | 0 | 7 | 410 | Absent | 0.74 | 1544 | 4.6 | Comparative example |
| 33 | 37 | 14 | 5 | 0 | 63 | 0 | 4 | 95 | Absent | 0.38 | 912 | 2.5 | Comparative example |
| 34 | 100 | 92 | 8 | 0 | 0 | 0 | 5 | 120 | Absent | 0.53 | 1539 | 4.6 | Comparative example |

*V(H): total area fraction of lower bainite, martensite, and retained austenite, V(M): area fraction of martensite, V(γ) area fraction of retained austenite, V(P): area fraction of pearlite, V(S): total area fraction of upper bainite and ferrite, V(Fs): area fraction of elongated ferrite phase grains having an aspect ratio of 3 or more, D(M): average crystal grain size of martensite included in a region extending 50 μm from a surface of the steel sheet

*1: oxide particles having a minor axis length of 0.8 μm or less in the region extending 50 μm from the surface of the steel sheet,

*2: coarse oxide particles having a minor axis length of more than 1.0 μm in the region extending 50 μm from the surface of the steel sheet

*The underlined values are outside the scope of the present invention.

In Invention examples, the ratio R/t was 1.5 or less when the TS was 980 MPa or more and less than 1180 MPa, 2.5 or less when the TS was 1180 MPa or more and less than 1320 MPa, 3.5 or less when the TS was 1320 MPa or more and less than 1600 MPa, and 5.0 or less when the TS was 1600 MPa or more and less than 2100 MPa. In contrast, in Comparative examples, which were outside the scope of the present invention, any of the intended TS and the intended bendability failed to be achieved.

INDUSTRIAL APPLICABILITY

Using the high-strength steel sheet according to aspects of the present invention for producing automotive components may markedly improve the collision safety and the fuel economy of automobiles.

The invention claimed is:

1. A high-strength steel sheet having a tensile strength of 980 MPa or more comprising:

a composition containing, by mass,

C: 0.05% to 0.40%,

Si: 0.10% to 3.0%,

Mn: 1.5% to 4.0%,

P: 0.100% or less excluding 0%,

S: 0.02% or less excluding 0%,

Al: 0.010% to 1.0%,

N: 0.010% or less, with the balance being Fe and inevitable impurities;

a microstructure including lower bainite, martensite, retained austenite, upper bainite, and ferrite wherein, a total area fraction of the lower bainite, the martensite, and the retained austenite is 40% to 100%, an area fraction of the retained austenite is 15% or less, and a total area fraction of the upper bainite and the ferrite is 0% to 60%, wherein, in the microstructure, an area fraction of elongated ferrite phase grains having an aspect ratio of 3 or more is 1% or less, an average crystal grain size of martensite included in a region extending 50 μm from a surface of the steel sheet is 20 μm or less, a content of oxide particles having a minor axis length of 0.8 μm or less in the region extending 50 μm from the surface of the steel sheet is $1.0\times10^{10}$ particles/$m^2$ or more, and a content of coarse oxide particles having a minor axis length of more than 1.0 μm in the region extending 50 μm from the surface of the steel sheet is $1.0\times10^{8}$ particles/$m^2$ or less; and a content of trapped hydrogen in the steel sheet is 0.05 ppm by mass or more.

2. The high-strength steel sheet according to claim 1, further comprising one or more elements selected from, by mass:

Cr: 0.005% to 2.0%,

Ti: 0.005% to 0.20%,

Nb: 0.005% to 0.20%,

Mo: 0.005% to 2.0%,

V: 0.005% to 2.0%,

Ni: 0.005% to 2.0%,

Cu: 0.005% to 2.0%,

B: 0.0001% to 0.0050%,

Ca: 0.0001% to 0.0050%,

REM: 0.0001% to 0.0050%,

Sn: 0.01% to 0.50%, and

Sb: 0.0010% to 0.10%.

3. The high-strength steel sheet according to claim 1, comprising a coating film constituted by one or more layers, the coating film being disposed on the surface of the steel sheet.

4. The high-strength steel sheet according to claim 1, comprising a galvanizing layer disposed on the surface of the steel sheet.

5. The high-strength steel sheet according to claim 1, comprising an alloyed hot-dip galvanizing layer disposed on the surface of the steel sheet.

6. The high-strength steel sheet according to claim 2, comprising a coating film constituted by one or more layers, the coating film being disposed on the surface of the steel sheet.

7. The high-strength steel sheet according to claim 2, comprising a galvanizing layer disposed on the surface of the steel sheet.

8. The high-strength steel sheet according to claim 2, comprising an alloyed hot-dip galvanizing layer disposed on the surface of the steel sheet.

9. A method for producing the high-strength steel sheet according to claim 1, the method comprising:

a hot-rolling step of rough-rolling a slab having the composition according to claim 1, subsequently performing descaling at a pressure of 15 MPa or more, then performing finish rolling at 800° C. to 950° C., performing cooling subsequent to the finish rolling, and then performing coiling at 550° C. or less;

an annealing step of heating a hot-rolled steel sheet produced in the hot-rolling step to 730° C. to 950° C. and performing holding at 730° C. to 950° C. in an atmosphere having a hydrogen concentration of 1.0% to 35.0% by volume and a dew point of −35° C. to 15° C. for 10 to 1000 s;

a cooling step of cooling a steel sheet treated in the annealing step to 600° C. at an average rate of 5° C./s or more, stopping the cooling at a temperature of more than Ms and 600° C. or less, subsequently performing retention at a temperature of more than Ms and 600° C. or less for 1000 s or less, and, subsequent to the retention, performing cooling to room temperature such that the average cooling rate between Ms and 50° C. is 1.0° C./s or more;

an elongation rolling step of rolling a steel sheet treated in the cooling step at an elongation ratio of 0.05% to 1%; and an aging treatment step of subjecting a steel sheet treated in the elongation rolling step to an aging treatment under conditions satisfying Formula (1) below, $$(273+T)\times(20+\log_{10}(t))\geq 6800, \quad (1)$$

wherein in Formula (1), T is an aging temperature in ° C. of 200° C. or less, and t is an aging time in hr.

10. A method for producing the high-strength steel sheet according to claim 1, the method comprising:

a hot-rolling step of rough-rolling a slab having the composition according to claim 1, subsequently performing descaling at a pressure of 15 MPa or more, then performing finish rolling at 800° C. to 950° C., performing cooling subsequent to the finish rolling, and then performing coiling at 550° C. or less;

a cold-rolling step of cold-rolling a hot-rolled steel sheet produced in the hot-rolling step at a rolling reduction ratio of 20% or more;

an annealing step of heating a cold-rolled steel sheet produced in the cold-rolling step to 730° C. to 950° C. and performing holding at 730° C. to 950° C. in an atmosphere having a hydrogen concentration of 1.0% to 35.0% by volume and a dew point of −35° C. to 15° C. for 10 to 1000 s;

a cooling step of cooling a steel sheet treated in the annealing step to 600° C. at an average rate of 5° C./s or more, stopping the cooling at a temperature of more than Ms and 600° C. or less, subsequently performing retention at a temperature of more than Ms and 600° C. or less for 1000 s or less, and, subsequent to the retention, performing cooling to room temperature such that the average cooling rate between Ms and 50° C. is 1.0° C./s or more;

an elongation rolling step of rolling a steel sheet treated in the cooling step at an elongation ratio of 0.05% to 1%; and an aging treatment step of subjecting a steel sheet treated in the elongation rolling step to an aging treatment under conditions satisfying Formula (1) below, $$(273+T)\times(20+\log_{10}(t))\geq 6800, \quad (1)$$

wherein in Formula (1), T is an aging temperature in ° C. of 200° C. or less, and t is an aging time in hr.

11. A method for producing the high-strength steel sheet according to claim 2, the method comprising:

a hot-rolling step of rough-rolling a slab having the composition according to claim 2, subsequently performing descaling at a pressure of 15 MPa or more, then performing finish rolling at 800° C. to 950° C., performing cooling subsequent to the finish rolling, and then performing coiling at 550° C. or less;

an annealing step of heating a hot-rolled steel sheet produced in the hot-rolling step to 730° C. to 950° C. and performing holding at 730° C. to 950° C. in an atmosphere having a hydrogen concentration of 1.0% to 35.0% by volume and a dew point of −35° C. to 15° C. for 10 to 1000 s;

a cooling step of cooling a steel sheet treated in the annealing step to 600° C. at an average rate of 5° C./s or more, stopping the cooling at a temperature of more than Ms and 600° C. or less, subsequently performing retention at a temperature of more than Ms and 600° C. or less for 1000 s or less, and, subsequent to the retention, performing cooling to room temperature such that the average cooling rate between Ms and 50° C. is 1.0° C./s or more;

an elongation rolling step of rolling a steel sheet treated in the cooling step at an elongation ratio of 0.05% to 1%; and an aging treatment step of subjecting a steel sheet treated in the elongation rolling step to an aging treatment under conditions satisfying Formula (1) below, $$(273+T)\times(20+\log_{10}(t))\geq 6800, \quad (1)$$

wherein in Formula (1), T is an aging temperature in ° C. of 200° C. or less, and t is an aging time in hr.

12. A method for producing the high-strength steel sheet according to claim 2, the method comprising:

a hot-rolling step of rough-rolling a slab having the composition according to claim 2, subsequently performing descaling at a pressure of 15 MPa or more, then performing finish rolling at 800° C. to 950° C., performing cooling subsequent to the finish rolling, and then performing coiling at 550° C. or less;

a cold-rolling step of cold-rolling a hot-rolled steel sheet produced in the hot-rolling step at a rolling reduction ratio of 20% or more;

an annealing step of heating a cold-rolled steel sheet produced in the cold-rolling step to 730° C. to 950° C. and performing holding at 730° C. to 950° C. in an atmosphere having a hydrogen concentration of 1.0% to 35.0% by volume and a dew point of −35° C. to 15° C. for 10 to 1000 s;

a cooling step of cooling a steel sheet treated in the annealing step to 600° C. at an average rate of 5° C./s or more, stopping the cooling at a temperature of more than Ms and 600° C. or less, subsequently performing retention at a temperature of more than Ms and 600° C. or less for 1000 s or less, and, subsequent to the retention, performing cooling to room temperature such that the average cooling rate between Ms and 50° C. is 1.0° C./s or more;

an elongation rolling step of rolling a steel sheet treated in the cooling step at an elongation ratio of 0.05% to 1%; and an aging treatment step of subjecting a steel sheet treated in the elongation rolling step to an aging treatment under conditions satisfying Formula (1) below, $$(273+T)\times(20+\log_{10}(t))\geq 6800, \quad (1)$$

wherein in Formula (1), T is an aging temperature in ° C. of 200° C. or less, and t is an aging time in hr.

13. The method for producing a high-strength steel sheet according to claim 9, wherein a coating film formation treatment is performed in any of the steps subsequent to the annealing step.

14. The method for producing a high-strength steel sheet according to claim 9, wherein a galvanizing treatment is performed in the cooling step.

15. The method for producing a high-strength steel sheet according to claim 10, wherein a coating film formation treatment is performed in any of the steps subsequent to the annealing step.

16. The method for producing a high-strength steel sheet according to claim 10, wherein a galvanizing treatment is performed in the cooling step.

17. The method for producing a high-strength steel sheet according to claim 11, wherein a coating film formation treatment is performed in any of the steps subsequent to the annealing step.

18. The method for producing a high-strength steel sheet according to claim 11, wherein a galvanizing treatment is performed in the cooling step.

19. The method for producing a high-strength steel sheet according to claim 12, wherein a coating film formation treatment is performed in any of the steps subsequent to the annealing step.

20. The method for producing a high-strength steel sheet according to claim 12, wherein a galvanizing treatment is performed in the cooling step.

21. The method for producing a high-strength steel sheet according to claim 14, wherein an alloying treatment is further performed subsequent to the galvanizing treatment.

22. The method for producing a high-strength steel sheet according to claim 16, wherein an alloying treatment is further performed subsequent to the galvanizing treatment.

23. The method for producing a high-strength steel sheet according to claim 18, wherein an alloying treatment is further performed subsequent to the galvanizing treatment.

24. The method for producing a high-strength steel sheet according to claim 20, wherein an alloying treatment is further performed subsequent to the galvanizing treatment.

* * * * *